US006669244B1

(12) United States Patent
Bredthauer

(10) Patent No.: US 6,669,244 B1
(45) Date of Patent: Dec. 30, 2003

(54) SECURABLE CANE BOLT

(76) Inventor: Fred D. Bredthauer, 29-200 Desert Charm Rd., Indio Hills, CA (US) 92241

( * ) Notice: Subject to any disclaimer, the term of this patent is extended or adjusted under 35 U.S.C. 154(b) by 0 days.

(21) Appl. No.: 09/923,961

(22) Filed: Aug. 8, 2001

(51) Int. Cl.[7] ..... E05C 1/04
(52) U.S. Cl. ..... 292/150; 292/DIG. 21
(58) Field of Search ..... 292/137, 149, 292/150, 152, 189, DIG. 21

(56) References Cited

U.S. PATENT DOCUMENTS

| | | | | | |
|---|---|---|---|---|---|
| 70,895 | A | * | 11/1867 | Pridham | 292/149 |
| 152,039 | A | | 6/1874 | Judd | |
| 167,338 | A | * | 8/1875 | Iles | 292/149 |
| 310,787 | A | * | 1/1885 | Buckley | 292/150 |
| 1,158,816 | A | * | 11/1915 | Leeds | 292/150 |
| 1,508,029 | A | * | 9/1924 | Segal | 292/57 |
| 2,448,239 | A | * | 8/1948 | Urberuaga | 292/229 |
| 2,514,668 | A | * | 7/1950 | Neunherz | 5/100 |
| 3,906,759 | A | | 9/1975 | Schwing et al. | |
| 4,061,370 | A | * | 12/1977 | Hauber | 292/175 |
| 4,315,648 | A | | 2/1982 | Labelle | |
| 4,944,169 | A | | 7/1990 | Labelle et al. | |
| 5,590,919 | A | | 1/1997 | Germano | |

FOREIGN PATENT DOCUMENTS

| | | | | |
|---|---|---|---|---|
| GB | 2067656 | * | 7/1981 | E05C/15/20 |

* cited by examiner

*Primary Examiner*—Gary Estremsky
(74) *Attorney, Agent, or Firm*—Dennison, Schultz & Dougherty

(57) ABSTRACT

A securable cane bolt is provided that depends from the bottom of a gate or door and extends into the ground to hold the gate or door in a closed position. The securable cane bolt includes a hand-operated fastening member that prevents the bolt from being raised until the fastening member is released, which fastening member is covered and rendered inaccessible when a second gate is closed adjacent to the first gate.

12 Claims, 3 Drawing Sheets

SECURABLE CANE BOLT

TECHNICAL FIELD

The present invention is directed toward a bolt for securing a door or gate, and more particularly, toward a lockable bolt for securing a door or gate which bolt cannot be raised when the door or gate is closed.

BACKGROUND OF THE INVENTION

Gates for selectively providing access to an enclosed area or for controlling access to a street, driveway or other pathway, are generally mounted between two spaced apart supports, which in turn may be part of a wall or fence. A pair of gates is often used, one gate being hingedly attached to each of the spaced-apart supports. The gates have inner edges which are juxtaposed or may even meet when the gates are both in a closed position, and one or both of the gates can be opened to allow a person or vehicle to pass therebetween.

It is known to secure such gates by using a cane bolt on a first one of the gates which bolt can be extended past the lower surface of the gate and into an opening in the ground. When the cane bolt is in this lowered position, the first gate cannot be moved. The cane bolt often includes an angled upper end that can be grasped by a user to lift the bolt from the round so that the gate can be opened. The first or second gate also includes another lock for securing the first gate to the second gate. This other lock may be an ordinary key-operated lock with a sliding bolt that extends between the first and second gates; alternately, a chain may be passed through a portion of each gate and secured with a padlock. However, in any such arrangement, the first gate is secured with respect to the ground and the second gate is secured to the first gate (and, optionally, to the ground with a second cane bolt).

If a cane bolt is used on a gate with openings, such as a gate formed from spaced-apart vertical bars, it may be possible for a person to reach through the bars and raise the cane bolt. With the bolt thus raised, it becomes easier to break the second lock by applying a force against the gates where they meet. Even when the cane bolt cannot be reached through the gate, it may be possible to insert a screwdriver or similar tool underneath a gate and raise the cane bolt out of the ground. Unless the gate is spaced from the ground by the smallest of clearances, a determined individual will likely be able to raise the cane bolt.

The cane bolt itself could be locked with a padlock to hold it in place, but this is expensive and makes a gate more difficult to open. It would therefore be desirable to provide a mechanism for securing a cane bolt that does not require the use of a padlock or separate key, that can be used even on gates having spaced-apart vertical bars, and that allows the cane bolt to be operated by a user in a manner similar to existing cane bolts.

SUMMARY OF THE INVENTION

These problems and others are addressed by the present invention which comprises a cane bolt that can be held in place by a simple, hand-operated mechanism which is inaccessible when the gate is closed. In a preferred embodiment, the securable cane bolt comprises a fastening member that extends through the cane bolt and into a portion of the gate so that the cane bolt cannot be moved until the fastening member is released. Preferably, the fastening member comprises a spring-biased pin or plunger that is biased into a locking position but which can be retracted against the force of the spring to release the fastener. Furthermore, the fastening member is preferably housed in a recess which itself is covered when the two opposing gates are closed, but easily accessible when the gates are opened. Thus, the cane bolt is mounted on one of the two gates and inserted into the ground in a known manner. However, a fastener is used to hold the cane bolt in place in a lower position. When the second gate is closed, the recess housing the securable cane bolt is covered by the second gate leaving the fastening member inaccessible.

It is therefore a primary object of the present invention to provide a mechanism for securing a pair of gates.

It is another object of the invention to provide a cane bolt that can be fixed in one or more positions.

It is a further object of the present invention to provide a cane bolt in a first gate with a fastening member that is inaccessible when a second gate is closed against the first gate.

It is still another object of the present invention to provide a cane bolt that cannot be raised when two gates are closed.

It is a still a further object of the present invention to provide a securable cane bolt that can be secured in two or more positions.

It is yet another object of the present invention to provide a securable cane-bolt that includes a spring-biased fastening mechanism.

BRIEF DESCRIPTION OF DRAWINGS

These and other objects of the present invention will be appreciated and understood by those skilled in the art from the detailed description of the preferred embodiments of the invention and the following drawings of which.

DETAILED DESCRIPTION OF THE INVENTION

Figure 1:
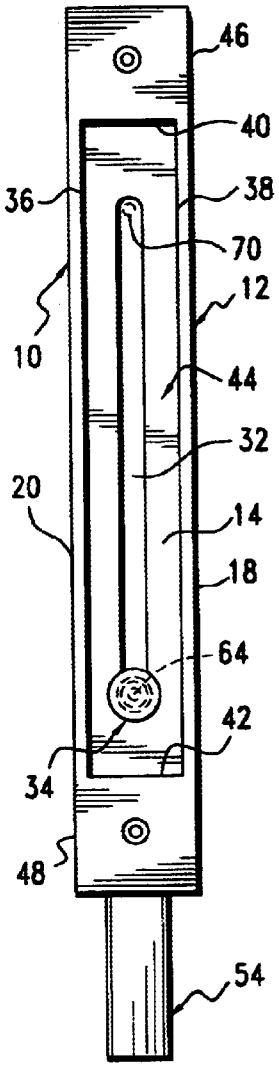
FIG. 1 is a front elevation view of a securable cane bolt having a fastening mechanism according the present invention.

Referring now to the drawings, wherein the showings are for the purpose of illustrating several embodiments of the invention only and not for the purpose of limiting the same, a securable cane bolt 10 is shown that includes an elongated housing 12 preferably having a rectangular shape. Housing 12 includes a front wall 14, a rear wall 16, a first sidewall 18 and a second sidewall 20, a top wall 24 having an opening 26, and a bottom wall 28 having an opening 30 aligned with opening 26 in top wall 24. Front wall 14, as will be explained in a greater detail, includes an elongated slot 32 extending from near the bottom wall 28 toward top wall 24.

First and second sidewalls 18, 20, extend beyond front wall 14 to define a channel 44 along the length the front wall.

Similarly, top and bottom walls 24, 28 extend beyond front wall 14 to form top and bottom ends of the channel. Therefore, channel 44 is defined by a first wall portion 36, a second wall portion 38, a third wall portion 40, a fourth wall portion 42, and front wall 14.

Housing 12 also includes an upper flange 46 extending upwardly from the upper edge of third wall portion 40, and a lower flange 48 extending from the lower edge of fourth wall portion 42. As will be explained hereinafter, these flanges are used to secure cane bolt 10 to the inner edge of a gate. Upper and lower flanges 46, 48 each preferably have a screw opening 50 for receiving a fastening means such as, but not limited to, a screw 52. Housing 12 further includes a first receiving opening 69 and a second receiving opening 70.

The securable cane bolt further includes an elongated bolt 54 preferably having a cylindrical shape and a first end 56 and a second end 58. Bolt 54, preferably made of iron or steel, is slidably disposed within the housing between front and rear walls 14, 16 and extends through opening 26 in top wall 24 and opening 30 in bottom wall 28. Bolt 54 further includes a threaded transverse aperture 60 for receiving a fastening member 34. Aperture 60 extends across the diameter of cane bolt 54 and is preferably located about one third of the way between the ends of the bolt, closer to second end 58.

Figure 3:
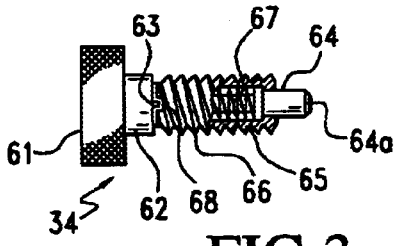
FIG. 3 is a side elevational view, partly in section, of the fastening mechanism shown in FIG. 1.

Fastening member 34, which is sometimes referred to hereinafter as a spring-biased plunger, is best seen in FIG. 3. While various fastening members could be used, a suitable device is available under the tradename "Vlier Knurled Knob Plunger" from APW Engineered Solutions in Brighton, Mass., U.S.A. Fastener 34 comprises a round, flat head portion 61 having a boss 62 extending from one face thereof, said boss including first and second diametrically opposed projecting lugs 63. A pin 64, having a distal end 64*a*, extends normally from boss 63 between the pins, and a sleeve 65 is coaxially mounted over the pin for longitudinal sliding movement with respect thereto and includes screw threads 66 on its outer surface. A spring 67 is mounted between sleeve 65 and pin 64 to bias sleeve 65 toward head 61. Thus, sleeve 65 can be moved longitudinally with respect to pin 64, but will return toward head 61 when released. Sleeve 65 further includes first and second diametrically opposed notches 68 at the end thereof closest to head 61 which are sized and shaped to receive lugs 63. The amount of pin 61 extending from sleeve 65 varies depending on whether lugs 63 are received in notches 68 or offset from the notches.

Sleeve 65 of fastening member 34 is screwed into aperture 60 of bolt 54, with lugs 63 positioned in notches 68, until the distal end of pin 64 enters first receiving hole 69. In this position, sleeve 65 is longitudinally fixed with respect to the bolt, but pin 64 is free to move within the sleeve when a user pulls head 61. The diameter of knob 61, and the height thereof, are selected so that plunger 34 and knob 61 have enough clearance from inner sides of first and second wall portions 36, 38 within channel 44, either in the locking position or unlocking position of bolt 54, to allow a user's fingers to grip to pull the knob 61.

Figure 2:
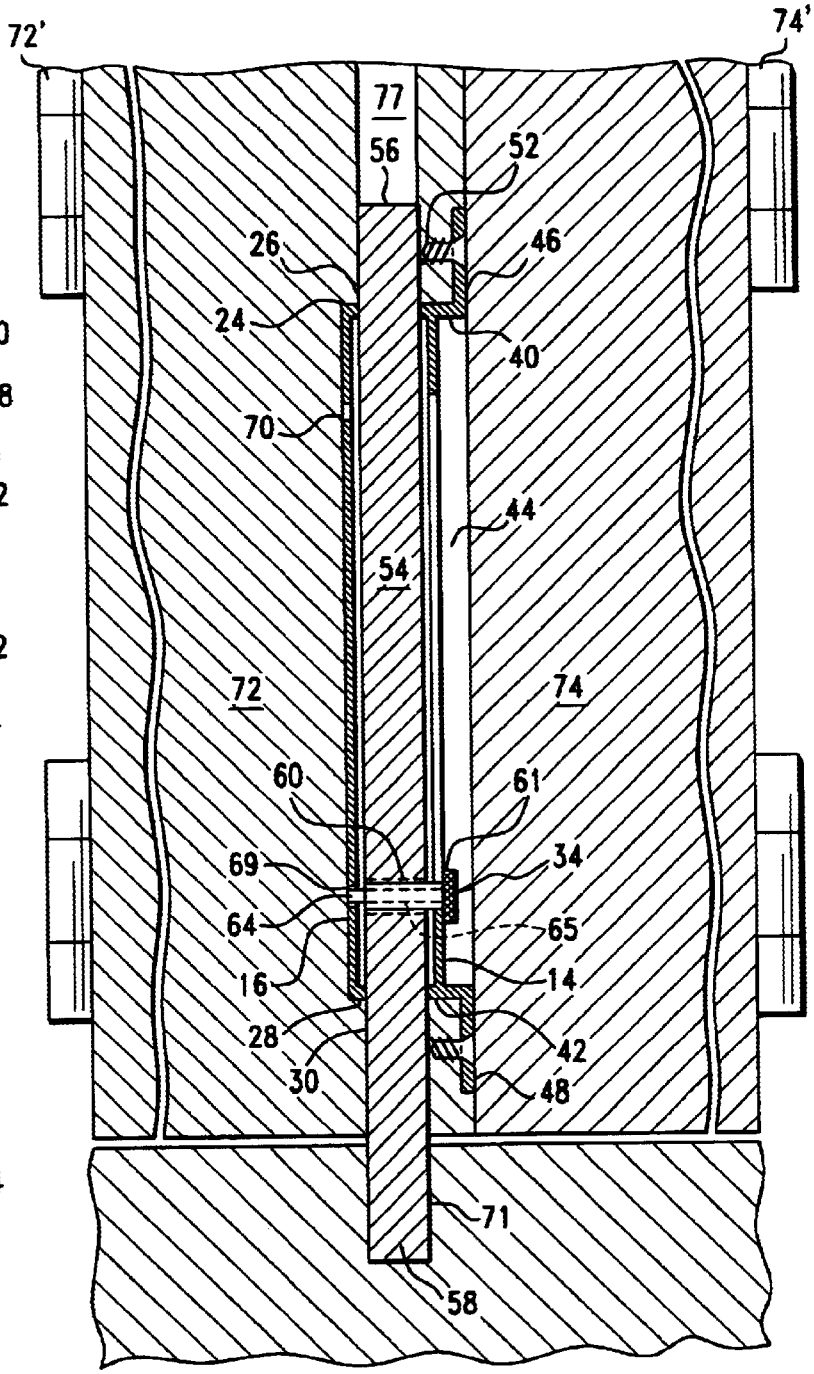
FIG. 2 is a sectional side elevation view of the securable cane bolt of FIG. 1 installed in a gate.

Referring now to FIG. 2, first and second hinged panels or gates 72, 74 are illustrated in a closed position with first hinged gate 72 being fitted with a securable cane bolt according to the present invention. First hinged gate 72 is hingedly connected to a first support 72' and the second hinged gate 74 is hingedly connected to a second, support 74'. Securable cane bolt 10 is secured on the inner edge of first hinged gate 72 within housing 77 with screws 52 threaded through upper and lower flanges 46, 48.

First and second hinged gates 72, 74 are illustrated in a closed position with no space between them; of course, there is often a slight spacing between two gates, and the present invention works for such gates as well. First hinged gate 72 is secured by bolt 54 with its second end 58 inserted into a ground hole 71. To lock gate 72 with respect to the ground, bolt 54 is moved into ground hole 71 until pin 64 is aligned with transverse aperture 60. Because spring 67 presses sleeve 65 away from head 61, the end of pin 64 distal from head 61 moves into first receiving hole 69 when the pin and receiving hole are aligned. This locks bolt 54 with respect to housing 12. In order to unlock securable cane bolt 10 and remove the cane bolt from the ground, plunger 34 is withdrawn by pulling knob 61 until pin portion 64 leaves hole 69 to release bolt 54. At this point, knob 61 can be rotated about 90 degrees so that lugs 63 are out of alignment with notches 68 in the sleeve. This holds distal end 64*a* of the pin away from bolt 54 and allows the bolt to be moved without the pin rubbing against the side of the bolt 54. The bolt is then raised until pin 64 is aligned with second receiving hole 70 and head 61 is rotated to align the lugs with the notches so that the distal end 64*a* of the pin will enter second receiving hole 70 and lock the bolt in an up position. Of course, it is not necessary to use a pin having lugs and notches as described above—a user could manually hold pin 64 in its retracted position while moving the bolt, or alternately, the fastening member could be unscrewed from opening 54 until the distal end 64*a* is free of opening 69. However, the use of a spring-biased plunger as described above has been found to be the best way of practicing this invention. The bolt 54 can be returned to a lower, locking position by reversing the above steps.

It should be appreciated that underlying the present invention is the recognition that spring-biased plunger 34 becomes inaccessible when first and second hinged gates 72, 74 are in a closed position, as seen in FIG. 2, since the inner edge of second hinged door 74 becomes flush against or closely spaced from channel 44 and thus prevents a person from gaining access to knob 64. As stated earlier, plunger 34 is configured and dimensioned to remain within the channel and in a clearance position from the inner edge of the second hinged gate when the plunger is in a first locking position, thereby allowing the second hinged gate to swing closed. Furthermore, the arrangement described above prevents the bolt from being forced upwardly from beneath the gate using a screwdriver or other tool.

It should further be appreciated that while sleeve 65 of the plunger is slidable along elongated slot 32 of front wall 14, it also prevents cane bolt 54 from rotating axially. This will also allow pin portion 64 be accurately positioned and aligned with first or second receiving holes 69 and 70 on rear wall 16.

Figure 4:
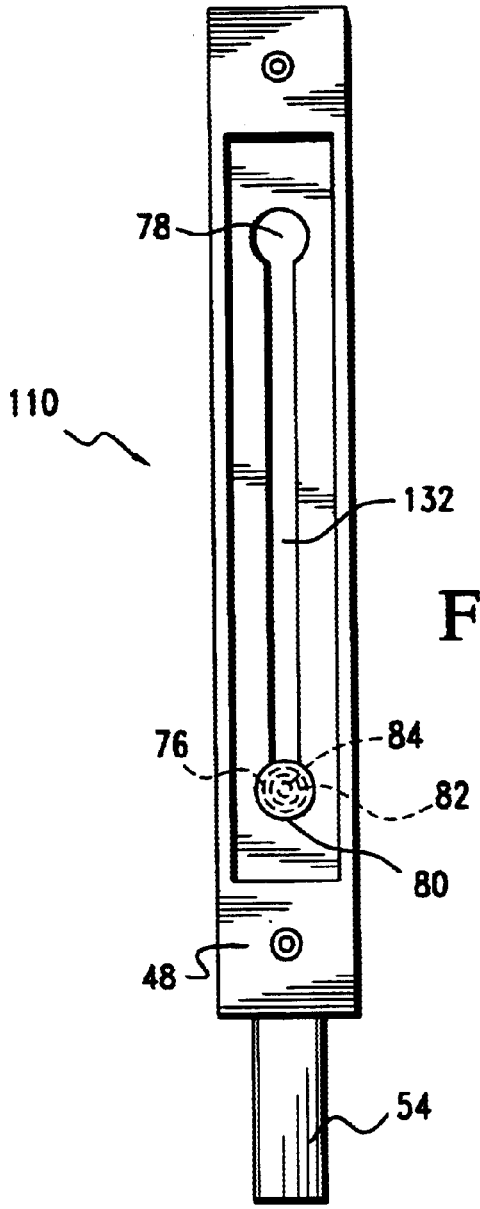
FIG. 4 is a front elevation view of a second embodiment of a securable cane bolt according to the present invention.
Figure 5:
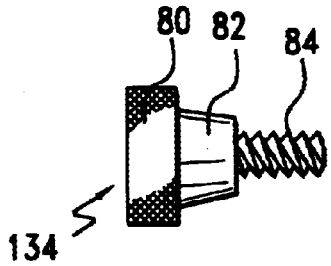
FIG. 5 is side elevational view of the fastening mechanism of shown in FIG. 4.

Referring now to FIGS. 4 and 5, a second embodiment of the securable cane bolt is illustrated at 110. In this embodiment, elements common to both the first and second embodiments are identified by like numerals. Broadly, the difference between the securable cane bolt in the second embodiment and the securable cane bolt in the first embodiment lies in the fastening member and portions of the elongated slot along the front wall.

More specifically, the front wall 14 is provided with an elongated slot 132 having first and second enlarged end portions 76, 78, and a fastening member 134 is provided having a head or knob 80, a tapered boss 82 attached to the head, and threaded portion 84 extending from the boss. Fastening member 134 is inserted into bore 60 so that threaded portion 84 passes through slot 132 with boss 82 spaced apart from the slot. In this configuration, bolt 54 is free to slide between a first position wherein fastening member 132 contacts end portion 76 and a second portion where the fastening member contacts the second opening 78. When the bolt is in the first position, the fastening member can be rotated and screwed further into bore 60 until shank 80 enters the enlarged end portion 76. The shank is small enough to fit within the enlarged end portion 76 but is wider than slot 132; therefore, bolt 54 is locked in place until the fastening member is unscrewed. Significantly, with this embodiment, there is no need to provide a hole in the housing to receive the end of the threaded portion, and if desired, bore 60 could be a blind bore rather than a through bore.

Figure 7:
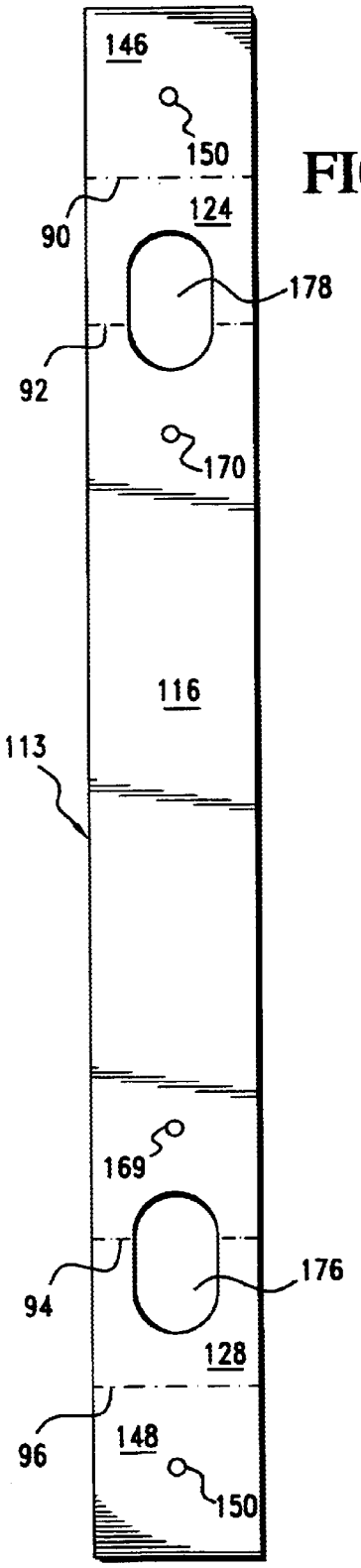
Figure 6:
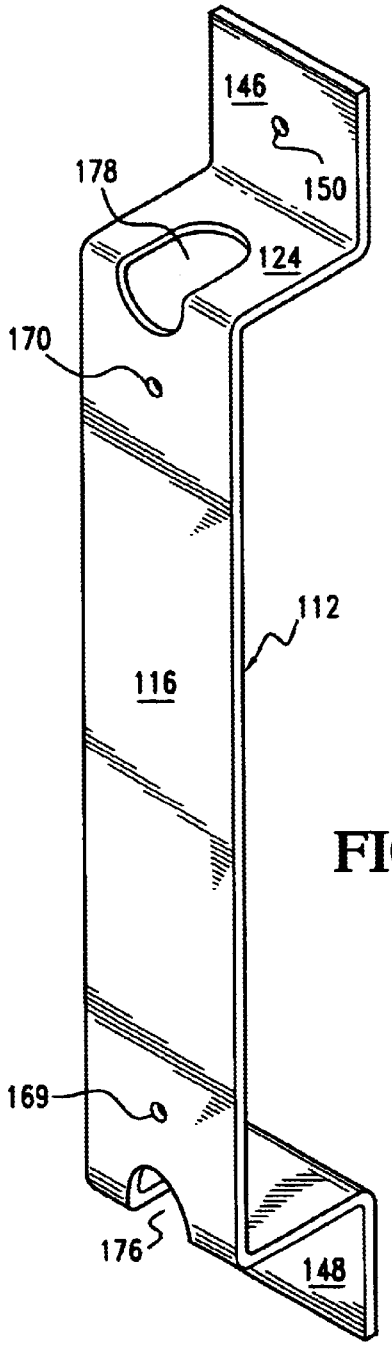
FIG. 6 is a perspective view of an alternate housing for the cane bolt of the subject invention; and, FIG. 7 is top plan view of a metal blank for forming the housing of FIG. 6.

Referring now to FIGS. 6 and 7, a second embodiment of a housing for supporting bolt 54 is illustrated at 112. In this embodiment, elements common to both the first and embodiments of the housing are identified by like numerals. Housing 112 is formed from a single piece of steel or similar material and includes a main wall 116 connected to a top wall 124 along a first fold line 92 and to a bottom wall 128 along a second fold line 94. Housing 112 further includes an upper flange 146 connected to top wall 124 along a third fold line 90, parallel with first fold line 92, and a lower flange 148 connected to bottom wall 128 along a fourth fold line 96, parallel to second fold line 94. Upper and lower flanges 146, 148 each preferably have a screw opening 150 for receiving a fastening means such as, but not limited to, a screw 52.

Main wall 116 includes a first receiving hole 169 configured and dimensioned to receive the pin portion of the spring-biased plunger for locking the cane bolt in a lower position, and a second receiving hole 170 configured and dimensioned to receive the pin portion of the spring-biased plunger for locking the cane bolt in an upper position.

Housing 112 also includes a first opening 176 formed in top wall 124 and main wall 116 which extends over fold or corner 92 and a second opening 178 formed in bottom wall 128 and main wall 116 that extends over fold or corner 94. A cane bolt 54 is slidably received in the top and bottom wall portions of these openings and functions as in the same manner discussed above.

A blank 113 for forming housing 112 is shown in FIG. 7 which blank is formed into the housing of FIG. 6 by folding along the various fold lines in a manner that will be readily apparent. Significantly, the provision of openings that extend over the fold lines helps minimize distortion of the openings in the top and bottom walls when the blank is folded. If circular openings were provided in the top and bottom walls, these openings would tend to deform during the bending process and then require significant drilling or reworking to return them to a suitable shape for receiving the bolt.

While preferred embodiments of the invention have been shown and described, various modifications and substitutions may be made thereto without departing from the spirit and scope of the invention. Accordingly, it is to be understood that the present invention has been described by way of illustration only, and this description should not be construed as limiting to the several claims appended hereto.

What is claimed is:

1. A securable bolt for securing a hinged panel having a first side hingedly connected to a support and a second side spaced apart from said first side comprising:

a housing located inside said hinged panel and having a rear wall and a first opening mounted on said second side, wherein said housing comprises a front wall parallel to said rear wall, said front wall having an elongated slot, first and second side walls extending from said rear wall past said front wall to define with said front wall a channel;

a rod having a longitudinal axis and a bore extending perpendicularly to said longitudinal axis, said rod being slidably supported by said housing for movement in a direction parallel to said longitudinal axis between a first position where said bore is aligned with said first opening and a second position; and, a fastening member mounted in said bore and movable into engagement with said first opening when said rod is in said first position.

2. The securable bolt of claim 1, wherein said fastening member and said bore are threaded.

3. The securable bolt of claim 1, wherein said fastening member further comprises:

a head;

a pin portion attached to said head at one end; and a threaded portion having a bore for receiving said pin portion, said threaded portion extends through said elongated slot on said front wall.

4. The securable bolt of claim 3, wherein said head is located on a first side of said front wall and said rod is located on a second side of said front wall.

5. The securable bolt of claim 4, wherein said first side wall includes an end spaced apart from said front wall and wherein said head is disposed between said front wall and said side wall end.

6. The securable bolt of claim 1 wherein said elongated slot has a first width and an enlarged portion at a first end thereof having a second width greater than said first width and wherein said fastening member comprises a threaded portion, a head and a shank between said threaded portion and said head, said shank having a width greater than said first width and less than said second width.

7. In a closure comprising first and second fixed supports, a first gate having a first side hingedly connected to said first support and a second side, and a second gate having a first side hingedly connected to said second support and a second side, wherein said first gate second side and said second gate second side are aligned when said first and second gates are aligned, and a bolt slidably supported on said first gate near said first gate second side for locking said first gate with respect to said first fixed support, and a housing disposed within said second side and includes a channel, the improvement comprising:

a transverse bore in said bolt and a fastening member shiftable with respect to said bore for selectably fixing said bolt relative to said first gate, wherein said fastening member extends into said channel, wherein access to said channel is blocked by said second gate when said first gate and said second gate are aligned, and wherein said fastening member includes a first portion having a first width and a second portion having a second width greater than said first width and wherein said channel includes a first portion having a first width and a second portion having a second with greater than said second portion first width, said bolt being fixed with respect to said channel when said fastening member second portion is in said channel first portion.

8. The gate of claim 7 wherein said channel includes a slot having a width and an end portion larger than said slot width and wherein said fastening member has a first portion having a first width less than said slot width and a second portion having a second width greater than said slot width.

9. The gate of claim 8 wherein said fastening member second width is less than the size of said enlarged end portion.

10. The gate of claim 9 wherein said fastening member comprises a sleeve having a longitudinal axis and pin mounted in said sleeve and spring-biased with respect thereto.

11. The gate of claim 9 wherein said fastening member comprises a spring-biased plunger.

12. In a closure comprising first and second fixed supports, a first gate having a first side hingedly connected to said first support and a second side, and a second gate having a first side hingedly connected to said second support and a second side, wherein said first gate second side and said second gate second side are juxtaposed when said first and second gates are aligned, a recess in said first gate second side, and a bolt slidably supported in said recess for movement between a first position where said bolt extends into a surface adjacent said first gate and a second position, the improvement comprising:

an opening in said recess and a threaded bore extending transversely through said bolt and aligned with said opening when said bolt is in said first position and a spring-biased plunger screwthreadedly engaging said threaded bore, said spring-biased plunger having a pin portion insertable into said opening when said bolt is in said first position, whereby said bolt cannot be removed from the surface adjacent said first gate when said pin portion of said spring-biased plunger is in said opening and whereby said recess is covered by said second gate when said first gate and said second gate are aligned.

* * * * *